US005320174A

United States Patent [19]

Terrell et al.

[11] Patent Number: 5,320,174

[45] Date of Patent: Jun. 14, 1994

[54] DOWNHOLE CHEMICAL CUTTING TOOL AND PROCESS

[76] Inventors: Jamie B. Terrell; Donna K. Terrell, both of 1916 Christopher Dr., Ft. Worth, Tex. 76140

[21] Appl. No.: 899,632

[22] Filed: Jun. 16, 1992

[51] Int. Cl.[5] ..... E21B 29/02

[52] U.S. Cl. ..... 166/297; 149/108.2; 166/55

[58] Field of Search ..... 166/55, 55.2, 297, 298; 149/108.2

[56] References Cited

U.S. PATENT DOCUMENTS

| | | | |
|---|---|---|---|
| 2,918,125 | 12/1959 | Sweetman | 166/297 |
| 3,066,058 | 11/1962 | Gall | 149/108.2 X |
| 3,076,507 | 2/1963 | Sweetman | 166/297 |
| 4,125,161 | 11/1978 | Chammas | 166/297 |
| 4,345,646 | 8/1982 | Terrell | 166/55 |
| 4,352,397 | 10/1982 | Christopher | 166/297 |
| 4,415,029 | 11/1983 | Pratt et al. | 166/212 |
| 4,446,920 | 5/1984 | Woytek et al. | 149/108.2 X |
| 4,494,601 | 1/1985 | Pratt et al. | 166/55 |
| 4,619,318 | 10/1986 | Terrell et al. | 166/55 |
| 4,971,146 | 11/1990 | Terrell | 166/55 |

FOREIGN PATENT DOCUMENTS

| | | | |
|---|---|---|---|
| 1108194 | 8/1984 | U.S.S.R. | 166/297 |

*Primary Examiner*—David J. Bagnell
*Attorney, Agent, or Firm*—Hubbard, Tucker & Harris

[57] ABSTRACT

Chemical cutting processes and tool for use in a well bore useful in the cutting of high strength and corrosion-resistant downhole tubular goods. The cutting tool has an elongated tool body adapted to be inserted into a well conduit and positioned at a downhole location for effecting a cutting action. The tool body comprises a chemical section and a cutting section having a plurality of cutting ports therein for discharge of the chemical cutting agent. The cutting ports extend transversely of the major axis of the elongated tool body and are arranged in at least first and second groups. The first group of cutting ports is arranged in a configuration conforming to the desired shape of the cut and define a first pattern. The second group of cutting ports conform generally to the first pattern and are in a canted relationship with respect to the first pattern. At least some of the cutting ports in the first group are in a staggered relationship relative to at least some of the cutting ports in the second group. Cutting ports maybe arranged circumferentially of the tool body to provide first and second planar patterns in a converging relationship such that they intersect at a locus externally of the tool body. The cutting ports may also be arranged to cut relatively large perforations in downhole tubular goods. The cutting ports lie in first and second ring-shaped configurations in an annular relationship with one another with one pattern forming a frustoconical configuration.

31 Claims, 7 Drawing Sheets

DOWNHOLE CHEMICAL CUTTING TOOL AND PROCESS

TECHNICAL FIELD

The invention relates to systems and processes for the cutting of downhole tubular goods and more particularly to such processes and systems which can be used to form cuts in high strength, high temperature alloy tubular goods.

BACKGROUND OF THE INVENTION

These are many circumstances in the oil industry where it is desirable to cut into or through downhole tubular goods within a well. For example, in the course of drilling a well, the drill pipe may become stuck at a downhole location. This may result from "keyseating" or as a result of cuttings which settle within the well around the lower portion of the drill string. In order to remove the drill string from the well, it may be necessary to sever the drill pipe at a location above the stuck point. Similarly, it is often necessary to carry out downhole cutting operations during the completion or operation or abandonment of oil or gas well. For example, it is sometimes desirable to sever casing or tubing at a downhole location in order to make repairs or withdraw the tubular goods from a well which is being abandoned or repaired. In most cases, the pipe is reusable. In other circumstances, it is desirable to cut slots, grooves or perforations in downhole tubular goods. Thus, it is a common expedient to perforate the casing and surrounding cement sheath of a well in order to provide fluid access to a hydrocarbon bearing formation. Similarly, it is sometimes desirable to perforate tubing in the completion or recompletion of a well.

Chemical cutters can be used to significant advantage in the application of chemicals to cut, sever or perforate downhole tubular goods. For example, U.S. Pat. No. 2,918,125 to Sweetman discloses a downhole chemical cutter which employs cutting fluids that react violently with the object to be cut with the generation of extremely high temperatures sufficient to melt, cut or burn the object. In the Sweetman procedure, halogen fluorides are employed in jet stream impinging on the downhole pipe to sever or perforate the pipe. The attendant reaction is highly exothermic and the pipe is readily penetrated. Examples of chemical cutting agents disclosed in Sweetman are fluorine and the halogen fluorides including such compounds as chlorine trifluoride, chlorine monofluoride, bromine trifluoride, bromine pentafluoride, iodine pentafluoride and iodine heptafluoride. The cutting fluid is expelled from the tool through radial ports in jet cutting streams. In Sweetman, the cutting ports extend radially from a central bore within the discharge head of the cutting tool which terminates in a reduced diameter bore which is open to the lower or front end of the cutting tool. The reduced diameter bore is internally threaded to receive a threaded plug which closes the lower end of the bore.

As further disclosed in U.S. Pat. No. 4,619,318 to Terrell et al., objects may be perforated or in some instances, completely dissolved with no debris left in the well through the use of a downhole chemical cutter. As disclosed in this patent, the chemical cutting tool may be provided with a downwardly extended nozzle provided with a suitable stand-off sleeve. In addition to the halogen fluoride cutting agents as disclosed in the aforementioned patent to Sweetman, further cutting agents as disclosed in the Terrell et al. patent include nitrogen fluoride sources.

Other than the particular adaptation of a nozzle configuration as described in the aforementioned Terrell et al. patent, the normal practice in severing downhole tubular goods is to arrange the cutting ports which are located on the circumferences of the cutting head radially and perpendicular to the centerline of the tool, defining a disk-like planar pattern. Thus, in U.S. Pat. No. 3,076,507 to Sweetman, a cutting head is disclosed in which a plurality of jet passages of restricted diameter extend radially through the wall of the cutting head body in a single plane perpendicular to the vertical centerline of the head. A similar configuration is disclosed in U.S. Pat. No. 4,125,161 to Chammas. Here, the cutting head is a cylindrical member provided with a plurality of discharge ports arranged radially about the outer diameter of the head through which the chemical cutting agent issues in a plane generally perpendicular to the vertical centerline of the head. The cutting ports are bridged with a piston provided with o-rings to prevent the entry of fluids through the ports. A lower portion of the tool is provided with openings through which well fluid exerts hydrostatic pressure on the bottom of the piston, holding the piston in place before the tool is fired.

Yet another chemical cutting tool is disclosed in U.S. Pat. No. 4,494,601 to Pratt et al. Here, a lower part of the cutting head structure is open to well fluid and a piston plug is interposed immediately above the cutting ports. The cutting ports may be closed to the exterior of the well by means of an internal sleeve positioned in the bore of the cutting head immediately in front of the piston. As in the cutting tools described above, the cutting ports lie in a single plane perpendicular to the centerline of the tool.

SUMMARY OF THE INVENTION

In accordance with the present invention there are provided a new chemical cutting processes and tool incorporating with a cutting head assembly which is particularly useful in the cutting of high strength and corrosion-resistant tubular goods such as high chrome-nickel stainless steel. In one aspect of the invention there is provided a method of cutting tubular well goods at a downhole location within a well extending into the earth from a well head. In carrying out the invention, a chemical cutting tool is inserted into the well and into the interior of the tubular member to be cut. The cutting tool has a chemical section that contains a cutting agent that interacts with the tubular member to form a cut therein and further comprises a cutting section adapted to receive the chemical cutting agent from the chemical section. After lowering the chemical tool to the desired location within the tubular member at which the cut is made, the cutting agent is discharged from the chemical section into contact with an ignitor material to effect an exothermic prereaction of the cutting agent. The ignitor material is formed of a permeable accumulation of first and second metallic components or more metallic, organic or inorganic components. The first component is formed of a first metal which is reactive with the cutting agent in an exothermic reaction at a first temperature and the second component interposed within the first component is reacted with the cutting agent in an exothermic reaction at a second higher temperature. The pre-ignited chemical cutting agent is disposed from the cutting tool in a plurality of jet streams emanating from cutting ports in the cutting section of the tool and into contact with the inner surface of the tubular member to effect a cut therein. Preferably, the cutting agent is dispensed from first and second groups of cutting ports. The first group of ports are arranged in a configuration forming in the desired shape of the cut in the tubular member and define a first planar pattern. The second group of cutting ports are arranged in a second planar pattern. The second pattern generally conforms to the first pattern and is in a canted relationship with the second pattern.

In a further aspect of the invention, there is provided a downhole chemical cutting tool having an elongated tool body adapted to be inserted into a conduit such as a tubing string or casing within a well and positioned at a downhole location thereof for effecting a cutting action of the conduit. The tool body comprises a chemical section adapted to contain a chemical cutting agent and a cutting section adapted to receive the chemical cutting agent from the chemical section. The cutting section has a plurality of cutting ports therein for the discharge of the chemical cutting agent. The cutting ports extend transversely of the major axis of the elongated tool body and are arranged in at least first and second groups. The first group of cutting ports is arranged in a configuration conforming to the desired shape of the cut and define a first planar pattern. The second group of cutting ports conform generally to the first pattern and are in a canted relationship with respect to the second pattern. In a preferred embodiment of the invention, at least some of the cutting ports in the first group are in a staggered relationship longitudinally along the tool body relative to at least some of the cutting ports in the second group.

In one embodiment of the invention, the cutting ports in the elongated tool body are arranged circumferentially of the tool body to provide first and second planar patterns, generally normal to the major axis of the tool body. The planar patterns are in a converging relationship such that the intersect at a locus externally of the tool body.

A similar principle is applied in an embodiment of the invention adapted to cut relatively large perforations in downhole tubular goods. Here, the cutting ports lie in first and second ring-shaped configurations in an annular relationship with one another. The cutting ports within the inner ring configuration are on different radii than the cutting ports in the outer ring configuration, again providing for an increased metal volume around the cutting ports.

In yet a further embodiment of the invention, the first group of cutting ports are arranged in a generally ring-shaped configuration extending transversely from the longitudinal axis of the cutting tool. The second group of cutting ports are also arranged in a ring-shaped configuration lying within and in an annular relationship relative to the first pattern. In a preferred aspect of this embodiment of the invention, one of the patterns forms a frusto-conical configuration which may be either outwardly converging or outwardly diverging. Thus, the first outer pattern may be outwardly diverging to form one type of perforation in the tubular member or, alternatively, the inner pattern may be outwardly converging to form yet another type of perforation in the tubular member. Preferably, this embodiment of the invention incorporates yet a third group of cutting ports defining a third planar pattern located below the first pattern and generally conforming to the second and third patterns. More specifically, the first and third patterns diverge downwardly and upwardly, respectively; the second pattern is essentially a horizontal plane bisecting the angle between the first and third patterns.

DESCRIPTION OF THE PREFERRED EMBODIMENTS

The present invention provides a chemical cutting tool which can be effectively used in cutting, severing or perforating downhole tubular members formed of metal alloys which are extremely tough and difficult to cut while at the same time, providing a tool having an extended effective life. This is accomplished in the present invention through the use of cutting heads having the cutting ports therein arranged in novel configurations and further, through the use of multi-component pre-ignition materials which are particularly effective for use in chemical cutting tools embodying such cutting heads.

A weak link that may limit the life of a chemical cutter head is due to the cutting ports of the head. Characteristically, for prior art chemical cutter heads, the least amount of metal in the head will be found in the perpendicular plane that passes through the longitudinal center of these cutting ports. The present invention provides chemical cutting heads having cutting port configurations which enable the cross-sectional areas of the metal in this critical area to increase by a factor of almost three. In one embodiment of the invention, this is accomplished by alternately placing each second port, one diameter hole (or more) above the first port and the third port, one diameter hole below the first port of each group of three ports. This pattern is completed around the total circumference of the head. The second and third holes of each group are placed in tilted frusto-conical planes in which the exit jets converge in a common frustoconical plane at the interior of the wall of the pipe to be cut. In addition to added strength, a superior heat transfer in the critical region is accomplished. The life of a cutting head is usually determined by the integrity of the port holes. Typically, after a few cuts (occasionally only one cut in mud or weighting fluids such as calcium chloride or calcium bromide), the holes become too enlarged to form evenly spaced jets around the circumference of the head. Also, the jets from these enlarged port holes are too large in diameter to impinge the interior of the pipe with sufficient velocity to initiate the chemical reaction between the hot fluorine and the metal of the pipe. For most applications, the diameter of each port hole will be between 0.053 inch and 0.093 inch in diameter. Therefore, due to the increased volume of metal around the port holes provides for enhanced heat dissipation in the head and more heat flow from the port holes is accomplished.

For a further description of the present invention, reference will be made to the drawings with regard to which the invention will be described in detail.

Figure 1:
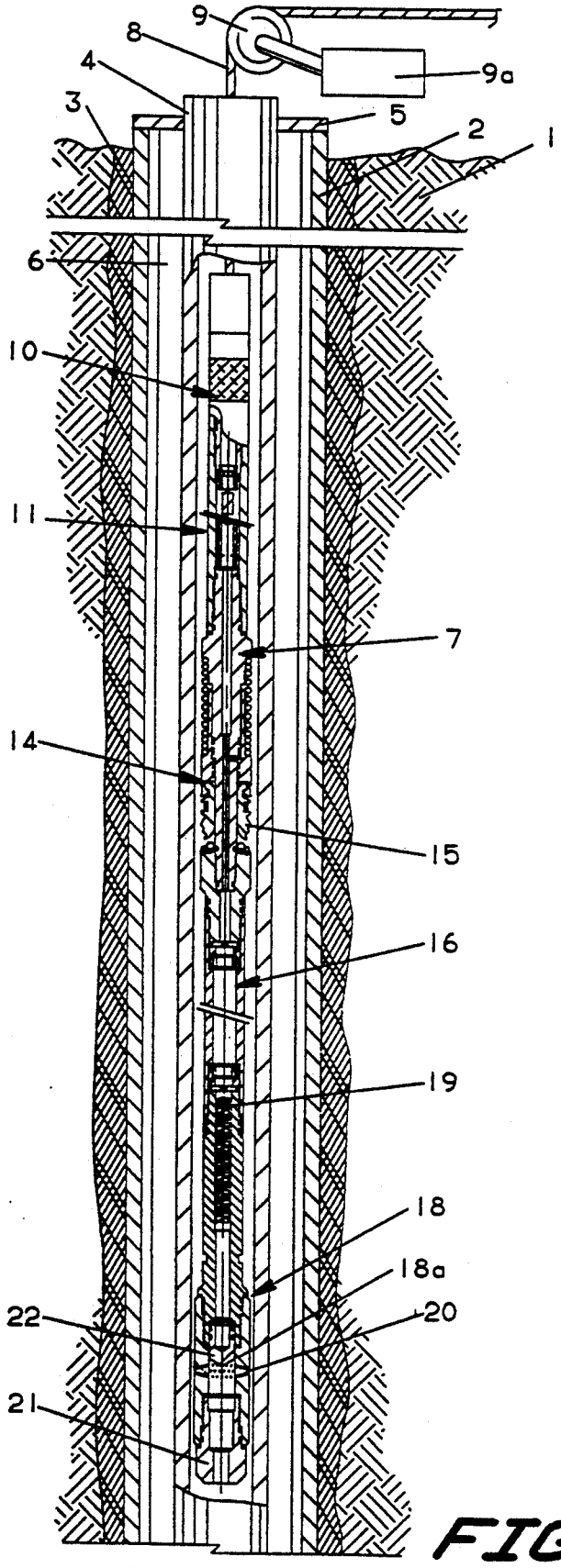
FIG. 1 is an illustration, partly in section, showing a downhole chemical cutter located in a well.

The invention will now be described in detail. Shown in FIG. 1 of the drawings, there is illustrated a chemical cutting tool embodying the present invention disposed within a well extending from the surface of the earth to a suitable subterranean location, e.g., an oil and/or gas producing formation (not shown). More particularly, and as is illustrated in FIG. 1, as well bore 1 is provided with a casing string 2 which is cemented in place by means of a surrounding cement sheath 3. A production tubing string 4 is disposed in the well as illustrated and extends from the well head 5 to a suitable downhole location. The tubing string and/or the annular space 6 between the tubing and the casing may be filled with high pressure gas and/or a liquid such as oil or water. Alternatively, the tubing string 4 or the annulus 6 may be "empty", i.e. substantially at atmospheric pressure.

As further illustrated in FIG. 1, there is shown a chemical cutting tool 7 which is suspended from a cable (wireline) 8. The cable 8 passes over suitable indicating means such as a measuring sheave 9 to a suitable support and pulley system. The measuring sheave produces a depth signal which is applied to an indicator 9*a* which gives a readout of the depth at which the tool is located. It will, of course, be recognized that the well structure illustrated is exemplary only and that the cutting tool 7 can be employed in numerous other environments. For example, instead of a completed well, the tool can be employed in severing a drill pipe in either a cased or uncased well. In this case, the tubing string 4 shown would be replaced by a string of drill pipe.

The chemical cutter 7 is composed of five sections. At the upper end of the tool there is provided a fuse assembly 10 comprised of a fuse sub and an electrically activated fuse (not shown). Immediately below the fuse assembly 10 is a propellant section 11 which provides a source of high pressure gas. For example, the propellant section 11 may take the form of a chamber containing a propellant, such as gun powder pellets, which burns to produce the propellant gases. Immediately below the propellant section 11 is a slip section 14 incorporating a slip array 15 that anchors the tool during the cutting cycle. A chemical module section 16 is located below the slip section 14. This section contains a suitable chemical cutting agent. Preferably, the chemical cutting agent will take the form of a halogen fluoride, more preferably, bromine trifluoride. Immediately below the chemical module section 16 is a head assembly 18. This section contains an "ignitor hair" 19 such as steel wool, preferably a mixture of steel wool and alloy shavings a described below, which activates the halogen fluoride, bringing it to a temperature that will quickly cut the tubing 4. The head assembly 18 also contains cutting ports 20 through which the fluid is directed against the interior wall of the tubing string 4. In the embodiment shown, the head section is equipped with the ports 20 extending about the periphery thereof to completely sever the tubing string 4 in the well. The port holes are arranged in a plurality of converging planar patterns generally normal to the major axis of the tool body. This arrangement greatly facilitates the severing of hard-to-cut high temperature alloy materials as described below.

Figure 2:
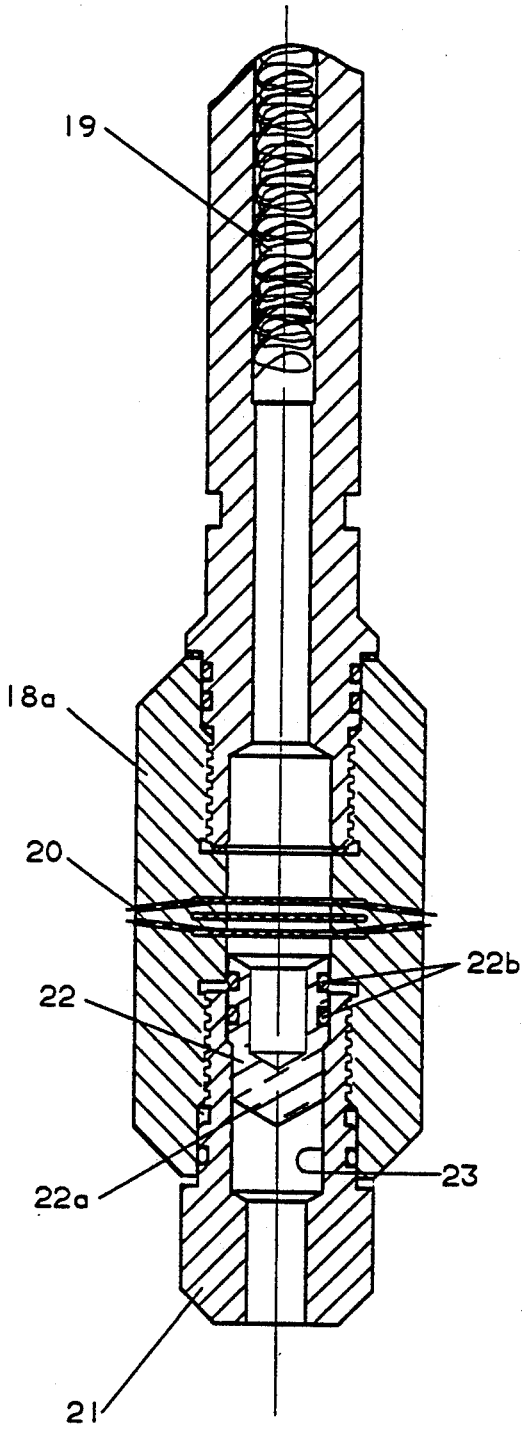
FIG. 2 is a sectional elevational view of a portion of the chemical cutter illustrating the arrangement of cutting ports in the cutting head in accordance with one embodiment of the present invention.

The head assembly 18 includes a bull nose sub 21 which is threadedly secured into a cutting head 18*a* containing the ports 20 and which is open at its lower end to provide a continuation of the central bore extending through the head assembly which is open to the well bore. A piston plug 22 is disposed in the central bore of the cutting head immediately above the level of the cutting ports 20. As described below, the piston plug is driven downwardly to a position below the cutting ports, as shown in FIG. 2 described hereinafter, and is wedged into slightly reduced diameter section of the bore as described in greater detail in the aforementioned U.S. Pat. No. 4,494,601 to Pratt and Terrell.

The operation of the chemical cutter tool 7 may be described briefly as follows. The tool is run into the well on the wireline 8 to the desired depth at which the cut is to be made. An electric signal is then sent via wireline 8 to the chemical cutter tool 7 where it sets off the fuse, in turn igniting the propellant. As the propellant burns, a high pressure gas is generated and travels downward through the slip section 14 and forces the slip array 15 outwardly in a manner described hereinafter. The slip away 15 thus anchors the chemical cutter tool 7 in the tubing string 4. As the gas pressure further increases, seal diaphragms within the chemical module section 14 are ruptured and the halogen fluoride or other cutting agent is forced through the ignitor hair 19 which ignites the chemical. The gas pressure then forces the activated chemical cutting agent into the head section 18 and ultimately outwardly through cutting ports 20. In a short period of time, normally less than a second, the tubing 4 is several and the slip array 15 is retracted so that the chemical cutter tool 7 can then be withdrawn from the tubing string 4. For a further description of the general operating conditions and parameters employed in the chemical cutter tool 7, reference may be made to the aforementioned U.S. Pat. Nos. 4,494,601 and 4,345,646 to Terrell and 4,415,029 and U.S. Pat. No. 4,619,318 to Pratt and Terrell, the entire disclosures of which are incorporated herein by reference.

FIG. 2 illustrates a preferred embodiment of the invention in which the cutting ports are arranged in three planar patterns, identified below as planes A, B and C, which are in a converging relationship. The patterns converge such that they intersect at a location within the wall of the tubing string or other tubular member to be cut, as described in greater detail below with respect to FIG. 4. In FIG. 2, the preferred embodiments of this invention, the head assembly including the cutting head 18*a* is shown in detail after the tool has been fired and the head piston 22 has been wedged by cutting fluid pressure into the bull nose 21 as the cutting cycle is initiated.

As shown in FIG. 2, the lower portion of the bore 23 within the bull nose sub is slightly reduced with respect to the upper portion of the bore within which the piston plug is more readily slidable. In addition, the lower portion 22a of the piston plug is reduced slightly with respect to the upper portion of the piston carrying o-rings 22b to an outer diameter slightly larger than the diameter of reduced section 23. As a result, upon firing the tool, the piston plug is securely wedged into the lower portion of the bull nose sub 21, where it remains after the cutting action is completed and the tool withdrawn.

Figure 3:
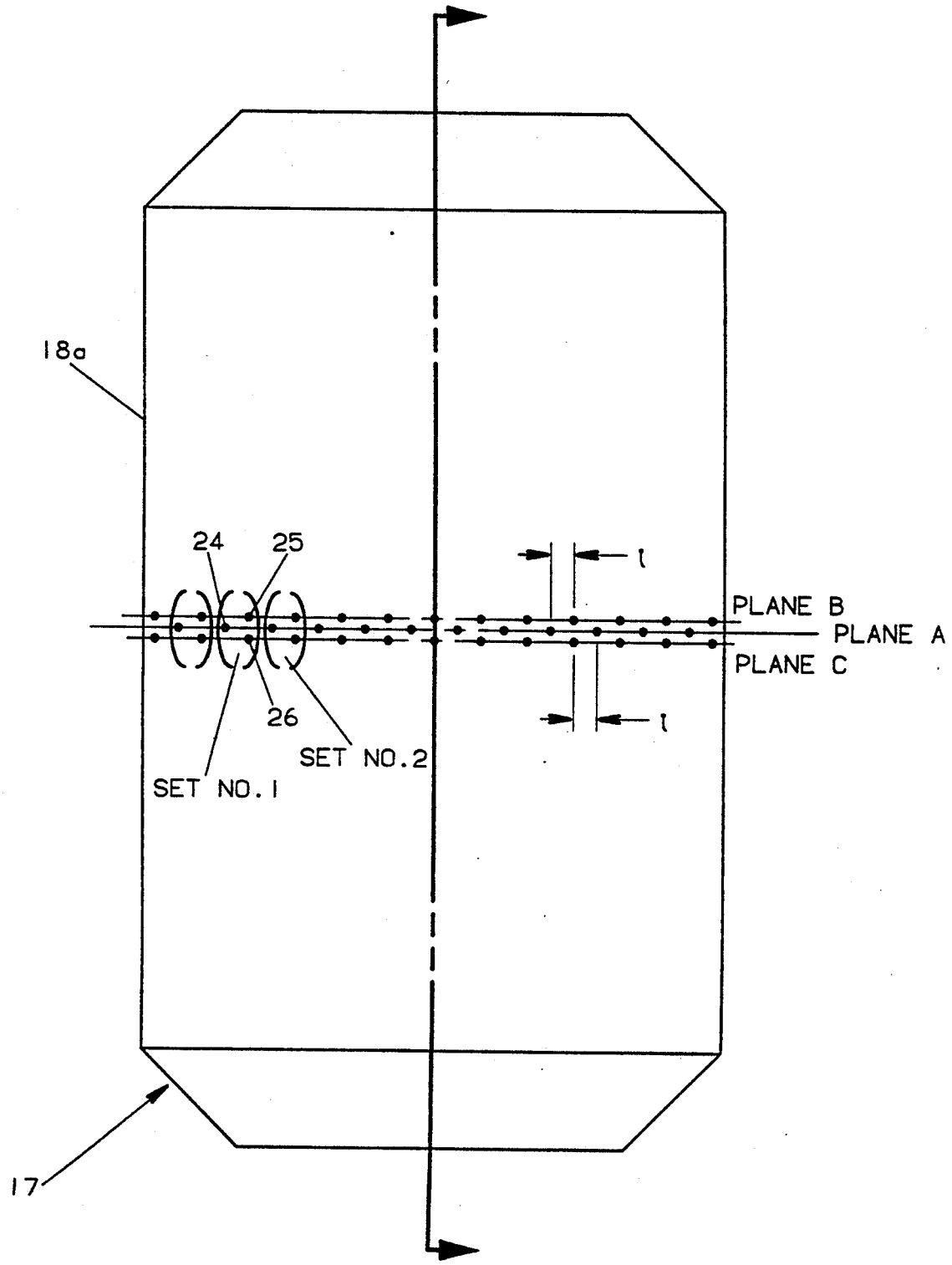
FIG. 3 is a side elevation of the cutting head shown in FIG. 2 illustrating the pattern of cutting ports arranged in sets in accordance with the present invention.
Figure 4:
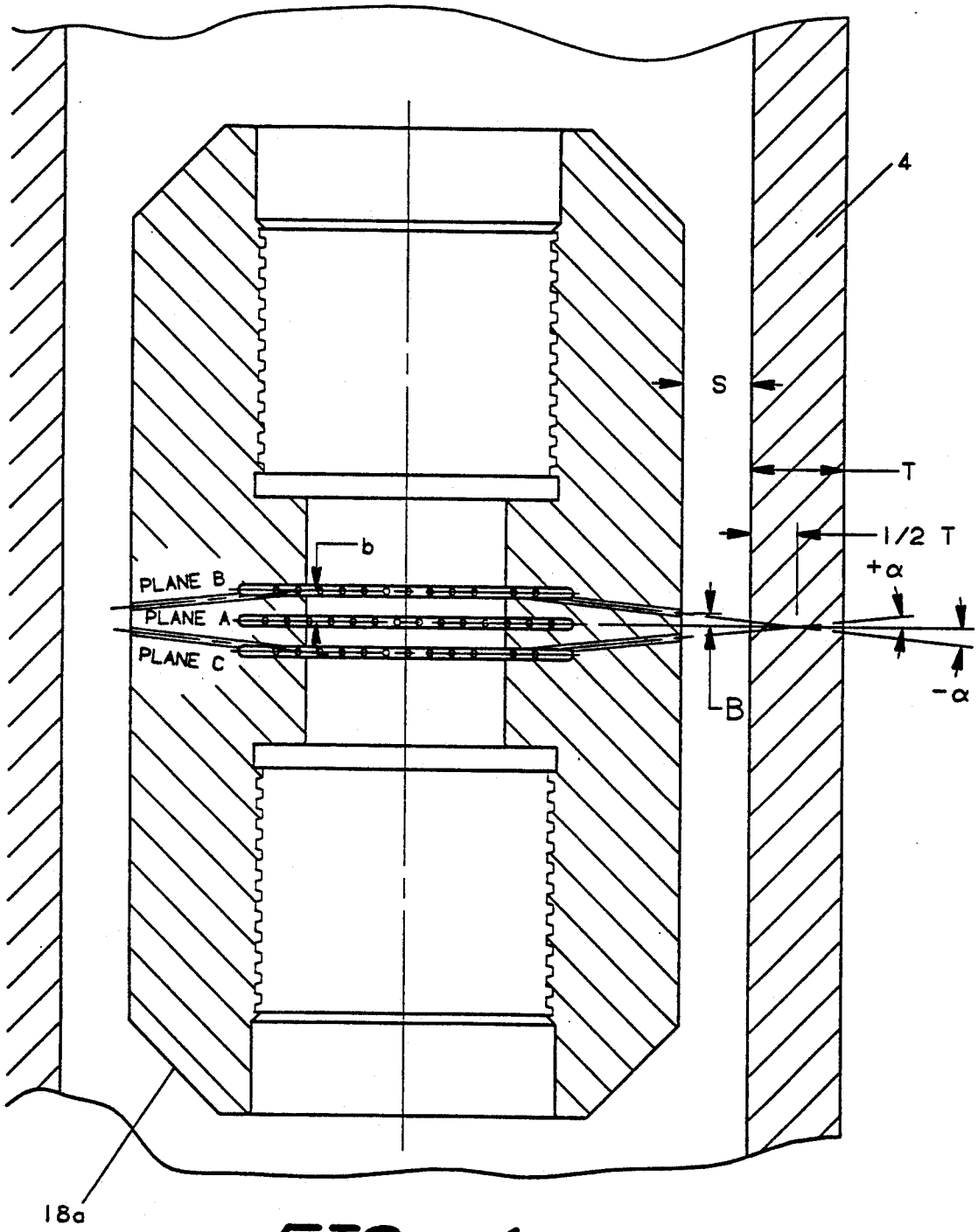
FIG. 4 is a sectional view of the cutting head of FIG. 3 taken along the lines 3—3 and further showing the cutting head within the tubular member to be cut.

A preferred orientation of the cutting ports for planes A, B, and C is shown in FIG. 3. FIG. 3 illustrates the port holes as drilled insets of three each. For example, the first port hole 24 in set no. 1 is placed in a perpendicular plane A with respect to the vertical centerline of the head 18a. The second port hole 25 is located in frustoconical plane B which is tilted with respect to plane A so that the two planes converge. The third port 26 is located in a frustoconical plane C (which is also tilted relative to plane A). As shown in FIG. 4, the angle of tilt of frustoconical plane B is such that the jet of cutting fluid from port hole 25 will meet of the intersection of plane A and frustoconical plane B at the desired distance of one-half the wall thickness of pipe 4 that is being severed, as explained in greater detail below. Likewise, the angle of tilt of frustoconical plane C is such that the jet of cutting fluid from port 26 will meet at the intersection of perpendicular plane A and frustoconical plane C at the desired distance of one-half T of pipe that is being severed. As shown in FIGS. 3 and 4, perpendicular plane A, frustoconical planes B and C preferably are separated at one outer surface of the head 18a by at least one diameter of a port hole. The distance B of FIG. 4 is the distance from the center of one port hole of a tilted frustoconical plane (C or B) to the center of a port hole in the perpendicular plane A, as measured vertically on the outside cylindrical surface of head 18a. The remaining sets of port holes are drilled in like manner around the circumference of head 18a. In FIG. 4 the wall thickness of the pipe 4 is designated as T. The nominal distance that the head 18a is located from the interior surface of the pipe during the cutting cycle is designated as S and preferably is about 0.2 inches. It has been found that the location of the convergence point of the cutting jets is most effective if this convergence occurs at a point one-half the wall thickness of the pipe being cut. This convergence point then determines the tilt angle of frustoconical planes B and C with respect to perpendicular plane A.

Referring to head 18a, as shown in FIG. 4, the arrangement of the cutting ports can be illustrated by the following example. Assuming the outside diameter of the pipe 4 to be cut is 5.5 inches with a wall thickness T of 0.313 inches, the internal diameter of the pipe is 4.874 inches. If the outside diameter of head 18a is 4.5 inches, the distance S may be calculated as one-half of the difference between the outer head diameter and the pipe internal diameter, i.e., 0.187 inches. The cutting ports have diameters of 0.055 inch.

The value of S is referred to as the standoff value of the cut. The angle $\propto$ of each frustoconical plane B or C with respect to perpendicular plane A is determined by the following equation:

$$\tan \propto = B/(0.5 \text{ Pipe ID} - \text{Head O.D.}).$$

wherein B as previously explained is 0.55 inches and which is the distance between planes B or C and A at the outer surface of head 18a, and S and T are as defined above. For this example:

$$\tan \propto = (0.055\ 10.5\ (4.874-4.5)+5(0.313)$$

$$\tan \propto = 0.16$$

$$\propto = 9.1^{\circ}$$

Therefore, frustoconical plane B is inclined at an angle of −9.1 degrees with respect to perpendicular plane A and frustoconical plane C is inclined at an angle of +9.10 degrees with respect to perpendicular plane A.

The number of cutting ports in each frustoconical plane and the circumferential spacing of these holes may be determined as follows. Empirical consideration indicate that a cutting head of approximately 4.5 inches in outside diameter should have about 75 cutting ports. Therefore, assuming an equal number of cutting ports in each plane, perpendicular plane A and each tilted frustoconical plane B and C of FIG. 4 will contain 25 port holes. The planar centerline spacing (or circumferential separation distance) i of the holes around the outside diameter of the head 18a is determined as follows. Assuming that the cutting ports are arranged equally in three planes, the spacing or circumferential center to center distance between the holes in each of frustoconical plane will be 4.57 or 0.565 inch.

Assuming, as previously stated, that the perpendicular plane A and the tilted frustoconical planes B and C are separated on the outside surface of the head 18a by one port hole diameter 0.055, the head can be constructed as follows to provide the configuration shown in FIG. 3. Twenty-Five port holes are drilled in perpendicular plane A with circumferential centerline spacing of 0.565 inches. Then using any port hole in perpendicular plane A as a reference, 25 ports holes are drilled in plane B starting at a circumferential distance of 0.283 inch from the referenced port hole of plane A. Thus, with reference to the sets of holes shown in FIG. 3, hole 25 is radially displaced along the circumference of the head from hole 24 by a distance of ½ the centerline spacing or 0.283 inch. The same procedure can be used to drill the holes in plane C so that, again, hole 26 is drilled a radial distance from hole 24 of 0.283 inch. In this configuration, the holes of planes B and C are staggered with respect to the holes in plane A, but are in line with one another. An alternative configuration can be employed in which the holes of all three planes are staggered with respect to one another. In this case, the holes in plane B can be drilled starting from the reference hole of plane A by a distance of ⅓ of the center to center hole spacing or 0.188 inch. The holes in plane C can similarly be drilled, here starting by a radial distance along the circumference of the cutting head of 0.376 inch from the reference hole. The result, of course, would be a configuration in which the cutting ports in each of planes A, B and C are staggered with respect to one another.

Figure 5:
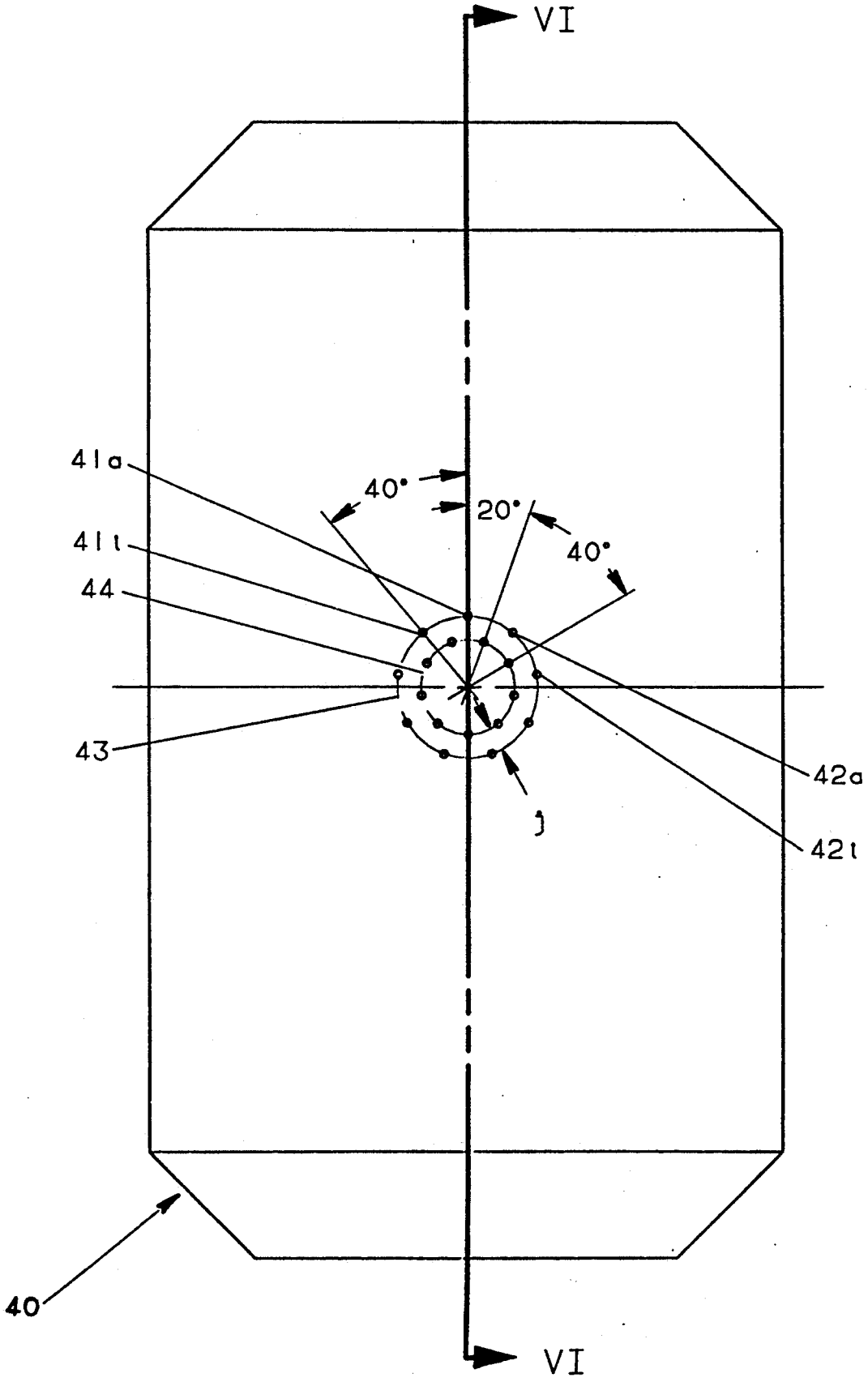
FIG. 5 is a side elevational view of a cutting head incorporating cutting ports in accordance with another embodiment of the invention.
Figure 6:
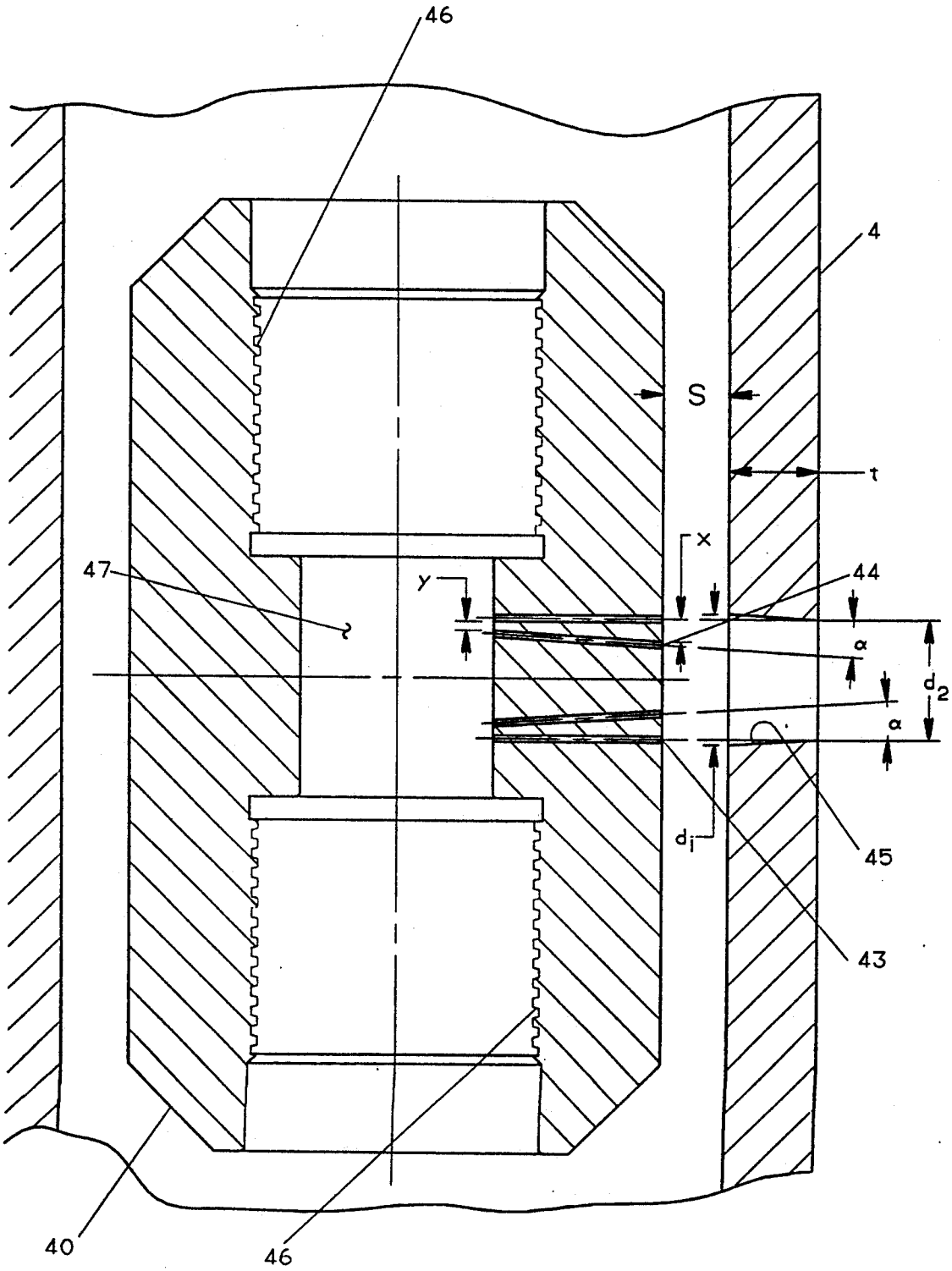
FIG. 6 is a longitudinal sectional view taken along line 6—6 of FIG. 5 and showing the cutting head within a tubular member.

Turning now to FIG. 5, there is shown an embodiment of the invention in which the loci of cutting port holes 41a–41i and 42a–42i are conformed in circles 43 and 44, respectively, on the surface of the head 40 from a centrally located perpendicular view with respect to the vertical axis of head 40. The head 40 is to be used in the head assembly of FIG. 1 (in place of head 18a) to perforate a large perforation 45 in pipe 4 as shown in FIG. 6. To illustrate the principle of constructing head 40 of this alternative embodiment, an actual example is given using the parameters listed in the following Table 1.

TABLE 1

Outside Diameter of pipe=5½ inches
Outside Diameter of head=4½ inches
Pipe Wall Thickness T=0.250 inches
Standoff, (S)=0.25 inches
Perforated Pipe Hole 45 diameter=1.0 inch (approximately)
Cutting Port Hole Diameter=0.055 inch The threads 46 and bore 47 are machined into head 40 by standard machining techniques. Then, nine port holes 41*a* through 41*i* in FIG. 5 are drilled to where the vertical center of each symmetrical port hole 41*a* through 41*i* is circumferentially located on the imaginary fiducial surface of a one inch cylinder whose circumference 43 is centrally located perpendicular to the vertical axis of head 40. Empirical considerations indicate that nine equally spaced port holes should be provided in each of cutting patterns which are the imaginary fiducial surface locations 43 and 44. The nine port holes 42*a* through 42*i* are drilled to where the vertical center of each port hole 42*a* through 42*i* is circumferentially located on a fiducial surface in the form of a truncated cone centrally located and of such a diameter and height that the exit loci of port holes 42*a* through 42*i* describe a circle 44 as viewed from a perpendicular location with respect to the vertical center of head 40. The circumference of circle 44 is separated from circle 43 by a constant separation distance of three port hole diameters, i.e., 0.165 inch as shown in FIG. 6. Empirically, the distance y should be the diameter of one port hole, which is the vertical internal surface distance of the exit loci of the port holes drilled by the imaginary fiducial surface locations patterns 43 and 44. As is also indicated in FIG. 5 the cutting ports in pattern 44 are on a different radii than the cutting ports in pattern 43. Specifically, the angel between adjacent radii of the cutting ports in a given pattern is 40° and the cutting ports on the inner pattern 43 are located midway between the cutting ports on the outer pattern 43, i.e., the closest cutting ports when going from one pattern to the next, lie on radii spaced 20° as shown in FIG. 5.

The use of head 40, appropriately connected to the chemical cutter 7 of FIG. 1 in place of cutting head 18*a*(this configuration is not shown), results in maximum penetration capabilities, requiring a minimum quantity of cutting fluid. The inside diameter $d_1$ of the perforation 45 may be twice as large in area as the outside diameter $d_2$ as shown in FIG. 6. Finally, as shown in FIG. 6, if the loci of the port holes 41*a*–41*i* and 42*a*–42*i* are drilled as delineated herein, the port holes 41*a*–41*i* will be skewed an angle of absolute value calculated as follows:

$$\tan \alpha = \frac{x - y}{.5} \text{ (Head outside diameter − head bore 47)}$$

$$\tan \alpha = \frac{.165 - .110}{.5} (4.5 - 1.630)$$

$$\tan \alpha = \frac{0.055}{1.435} = .03833$$

$$\alpha = 2.19°$$

Therefore, the imaginary fiducial surface location pattern 44 of FIG. 5 will be skewed with respect to the imaginary fiducial surface location pattern 43 at an angle $\alpha = 2.19°$ as shown in FIG. 6.

Figure 7:
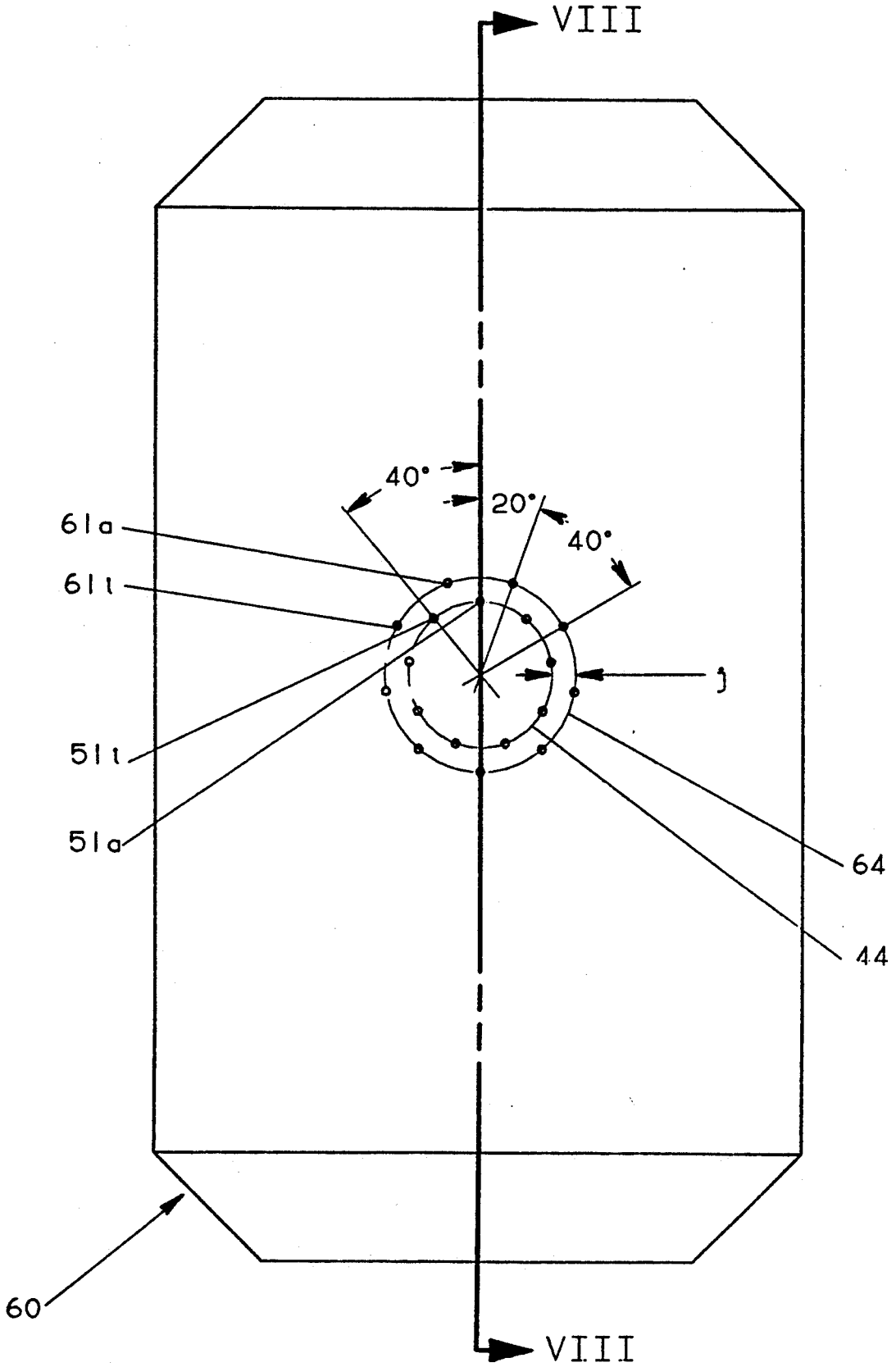
FIG. 7 is a side elevational view showing a cutting head with an arrangement of cutting ports in accordance with yet another embodiment of the invention.
Figure 8:
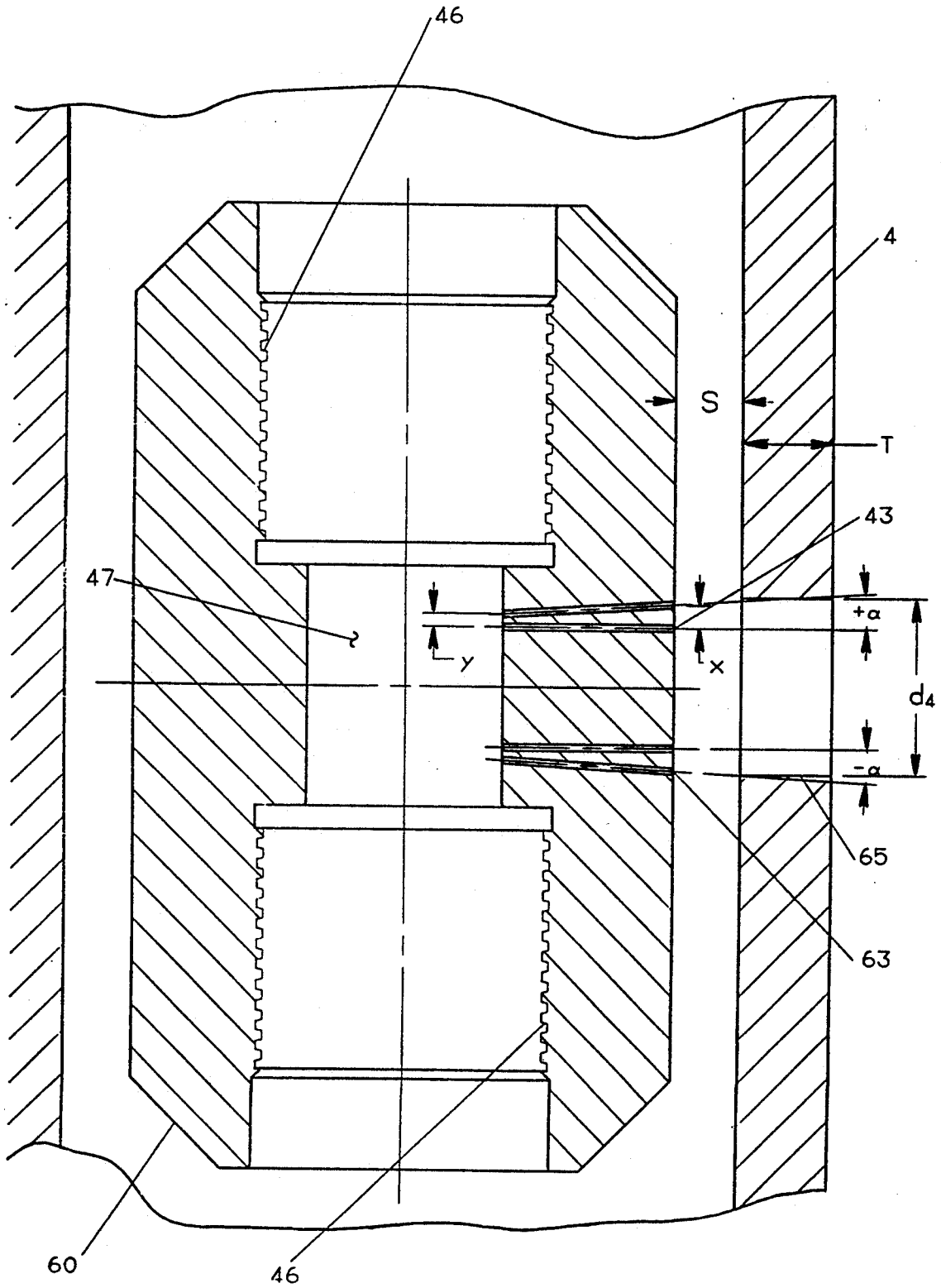
FIG. 8 is a side elevational view taken along line 8—8 of FIG. 7 showing the cutting head disposed within a tubular member.

Turning now to FIGS. 7 and 8, there is illustrated yet another embodiment of the invention employing a cutting head 60 which is similar to the embodiment shown in FIGS. 5 and 6 but with the cutting ports configured to produce a perforation in the tubing 4 having approximately equal inside diameters. FIGS. 7 and 8 are similar, respectively, in their views to FIGS. 5 and 6. FIG. 7 indicates a planar projection of a side elevation of the cutting head 60. FIG. 8 is a sectional view through the cutting head as located within the tubing 4 along section line 8—8 of FIG. 7.

Referring to FIGS. 7 and 8, cutting head 60 is constructed to produce a chemically cut perforation 65, FIG. 8, in the pipe 4 for which the inside diameter $d_3$ is approximately equal to the outside diameter $d_4$ in pipe 4 when head 60 is functionally deployed downhole connected to a chemical cutter 7, FIG. 1 (this configuration is not shown). In the construction of head 60 threads 46 and bore 47 are machined into head 60 by standard machining techniques. Then nine cutting port holes 61*a* through 61*i* are drilled to where the vertical center of each symmetrical port hole 51*a* through 51*i*, FIG. 7, is circumferentially located on the imaginary fiducial surface of a one-inch cylinder centrally located perpendicular to the vertical center of head 60. Similarly, as described above with regard to FIGS. 5 and 6, the number of equally spaced port holes should be equal to nine to achieve the most effective penetration of pipe 4. Then nine port holes 61*a* through 61*i* are drilled to where the vertical center of each port hole 61*a* through 61*i* is circumferentially located in the imaginary fiducial tesselated surface of a truncated cone central located and of such a diameter and height that the exit loci of port holes 61*a* through 61*i* describe a projected circle 64. The projected circle 64 is separated from the projected circle 63 by a constant separation distance of three port hole diameters, 0.165 inch. The chemically perforated hole 65 that is produced in pipe 4 by the use of heat 60 approximately connected to the chemical center 7 of FIG. 1 results in maximum penetration capabilities requiring a minimum quantity of cutting fluid. Additionally, the inside diameter $d_3$ of the perforation 65 is almost equal to the outside diameter $d_4$. Finally, as shown in FIG. 7, if the loci of the port holes 51*a*–51*i* and 61*a*–61*i* are drilled as delineated here; the port holes 61*a*–61*i* will be skewed an angle $\alpha$ as shown in FIG. 8 of 2.19°, for the parameters given above in Table 1.

The chemical cutting agent used to carry out the present invention may be of any suitable type as may be required depending upon the nature of the material in the tubular goods to be cut. As a practical matter, the chemical cutting agent normally will take the form of a halogen fluoride, specifically bromine trifluoride, as described previously. Other chemical cutting agents which can be used in the present invention can include nitrogen fluoride and mixtures of nitrogen fluoride and molecular fluorine as described, for example, in the aforementioned U.S. Pat. No. 4,619,318 to Terrell et al. As described there, a preferred form of such cutting agent comprises approximately equal parts of nitrogen, fluoride and fluorine. The gaseous chemical cutting agent may contain nitrogen fluoride in the form of nitrogen trifluoride ($NF_3$) tetrafluorohydrazine ($N_2F_4$) and difluorodizine ($N_2F_2$) compounds. Nitrogen trifluroide disassociates at elevated temperatures of about 1,100° K.–1,500° K. into the free radial $NF_2$ and fluorine. It also pyrolyzes with may of the elements to produce tetrafluorohydrazine and the corresponding fluoride. Tetrafluorohydrazine also diassociates at elevated temperatures in a reversible reaction to form the free radial $NF_2$. In practice, it is preferred that the cutting agent contain nitrogen trifluoride since it is a thermodynamically stable gas at the temperatures usually encountered and is available in commercial quantities.

The cutting agent source may comprise a solid perfluoroammonium salt which decomposes upon heating to produce a gaseous chemical cutting agent containing nitrogen fluoride. Suitable perfluoroammonium salts which may be employed in this regard include $NF_4SbF_6$, $NF_4AsF_6$, $NF_4Sb_2F_{11}$, $NF_4Sb_3F_{16}$, $(NF_4)_2TiF_6$, $(NF_4)SnF_6$, $NF_4SnF_5$, $NF_4BiF_6$, $NF_4BF_4$, $NF_4PF_6$, and $NF_4GeF_5$. These salts, when heated to temperatures on the order of about 300° C. and above, decompose to form $NF_3$ and $F_2$. For a further description of such cutting agents, reference is made to the aforementioned U.S. Pat. No. 4,619,318, the entire disclosure of which is incorporated herein by reference.

Regardless of the chemical cutting agent used, it is highly desirable to use the ignitor material as described above. The ignitor material may take the form of an "ignitor hair" such as steel wool or other similar metal having an intermeshing filamentary structure. As noted previously, steel wool, or steel wool mixed with an oil or another hydrocarbon, has conventionally been used as an ignitor material in chemical cutting application and ignitor hair thus formulated can be used in carrying out the present invention. However, a preferred application of the invention involves the use of an ignitor hair composite that raises the exit temperature of the cutting fluid to a value higher than that achieved either by steel wool itself or mixed with hydrocarbons. Second metal components which may be used to raise the temperature substantially include chips, powders or shavings of metals such as chromium, nickel, tatilium, titanium. Shavings from the same material as the material to be cut may be either mixed with the steel wool to form a composite ignitor.

In some cases, the ignitor hair need not contain iron but can be formulated of a predominantly non-ferrous material. For example, stainless steel shavings and non-ferrous powders, chips or filings can be used without the presence of steel wool, but mixed with oil or a similar organic material to effect initiation of the ignitor material. Various other materials which can be employed depending upon the nature of the material being cut can include steel wool plus stainless steel or steel wool plus shavings of nickel and chromium, tantillium and titanium. Usually, such mixtures will include grease, oil or other organic starter material.

In a preferred embodiment of the invention where the tubular goods to be cut are formed of high nickel chromium stainless steel or other similar material, a two-component ignitor hair can be used to facilitate pre-ignition of the cutting agent to the desired cutting temperature. The second metal component can be characterized as being more corrosion resistant than the first component due to the alloy mixtures which normally will be encountered in the second component. The second metal component can be tailored to the particular tubular goods to be cut and this can be most readily accomplished by simply forming shavings from an article formed of the same alloy as that forming the tubular goods which are to be cut in the well. Preferably, the shavings also are a filamentary nature which is integrated throughout the steel wool or other first metal component. Alternatively, chips or discrete particles such as stainless steel chips can be incorporated into the steel wool or other first metal component.

The operation of the two-component ignitor system can be illustrated by reference to use of the chemical cutting tool in cutting high nickel chrome stainless steel tubing which is used in oil wells subject to highly corrosive environments. Such tubing is formed of an alloy which may contain high amounts of chromium, e.g. 18 wt. % or more, and nickel is an amount of perhaps 50% of the chromium content. For example, such steel may contain in addition to iron and minor amounts of carbon, chromium in an amount of about 18 wt. % and nickel in an amount of about 8 wt. %. Where the preferred bromine trifluoride is used as a cutting agent, it can be expected to react exothermically with iron at a temperature of about 1,250° F. and with nickel at about 2,100° F. Chromium will react at a temperature between iron and nickel. Thus, in operation the iron (steel wool) component will react initially with the chemical cutting agent and the nickel or chromium, or more likely high nickel chromium stainless steel cuttings, will react with the already heated chemical cutting agent to boost the temperature still further so that it is at an appropriate temperature for immediately cutting the tubular goods as it exits the cutting head and impinges upon the interior surface of the tubing.

As a practical matter, the weight ratio of the two metal components will be within the range of about 1:3–3:1 and more preferably, usually in about 1:1 ratios. In addition, the ignitor material normally will contain a small amount of hydrocarbon such as grease or the like. For example, in an intermediate size chemical cutting tool adapted to cut tubing string having an inner diameter of about 3 inches, the ignitor hair may take the form of 4 grams of steel wool, 4 grams of grease and 4 grams of chromium chips or alternatively and more preferably, shavings of the same material as that forming the tubular member to be cut.

Having described specific embodiments of the present invention, it will be understood that modifications thereof may be suggested to those skilled in the art, and it is intended to cover all such modifications as fall within the scope of the appended claims.

We claim:

1. In a downhole chemical cutting tool having an elongated tool body adapted to be inserted into a conduit and positioned at a downhole location thereof for effecting a cutting action in said conduit, the combination comprising:

a) a chemical section in said elongated tool body adapted to contain a chemical cutting agent;

b) a cutting section in said elongated tool body adapted to receive a chemical cutting agent from said chemical section;

c) a plurality of cutting ports in said cutting section for the discharge of chemical cutting agent therefrom extending transversely of the major axis of said elongated tool body, said cutting ports being arranged in at least first and second groups;

d) said first group of cutting ports being arranged in a configuration conforming to the desired shape of a cut to be made in the conduit and defining a first pattern; and e) said second group of said cutting ports defining a second pattern generally conforming to said first pattern and being in a canted relationship with said first pattern.

2. The combination of claim 1, wherein at least some of the cutting ports in said first group are in a staggered relationship longitudinally along said body relative to at least some of the cutting ports in said second group.

3. The combination of claim 1, wherein said first and second groups of cutting ports are arranged circumferentially of said elongated tool body, in generally planar patterns which are generally normal to the major axis of said tool body.

4. The combination of claim 3, wherein said first and second planar patterns are in a converging relationship.

5. The combination of claim 4, wherein said first group of cutting ports defining said first planar pattern are in a downwardly converging relationship with respect to said second group of cutting ports defining said second pattern.

6. The combination of claim 5, wherein at least some of the cutting ports is said first group are in a staggered relationship longitudinally along said tool body relative to at least some of the cutting ports in said second group.

7. The combination of claim 5, further comprising a third group of cutting ports defining a third planar pattern generally conforming to said first and second planar patterns and being located below said second pattern.

8. The combination of claim 7, wherein said third planar pattern is in a converging relationship with said first and second planar patterns.

9. The combination of claim 1, wherein said first group of cutting ports are arranged in a ring-shaped configuration extending transversely from the longitudinal axis of said cutting tool and said second group of said cutting ports are arranged in a second ring-shaped configuration lying within and in an annular relationship to said first pattern.

10. The combination of claim 9, wherein at least one of said patterns is in frusto-conical configuration.

11. The combination of claim 10, wherein said inner pattern is in said outwardly converging frusto-conical configuration.

12. The combination of claim 10, wherein said outer pattern is in an outwardly diverging frusto-conical configuration.

13. The combination of claim 1, wherein said cutting tool comprises an accumulation of permeable ignitor material interposed between said chemical section and said cutting ports, said ignitor material comprising a first component formed of a first metal and a second component formed of a second metal which is more corrosion resistant than said first metal interposed with said first component.

14. The combination of claim 13, wherein said first component comprises iron and said second component comprises stainless steel.

15. In a well penetrating into the earth from a well head to a subterranean location, the combination comprising:

a) a tubular conduit within said well;

b) downhole chemical fluid jet cutting tool within said well at a downhole location;

c) a cable extending from the well head downwardly to said cutting tool and supporting said tool in said well, at said downhill location;

d) means for raising and lowering said cable and said cutting tool within said well;

e) said cutting tool comprising an elongated tool body;

f) anchoring means in with said tool body for anchoring said tool at a downhole location in response to the application of fluid pressure and for releasing said tool body in response to the release of said fluid pressure;

g) a chemical section in said tool body having a chamber herein adapted to containing a cutting fluid;

h) a cutting section in said tool body having a longitudinally extending bore in fluid communication with said chemical section whereby upon the application of pressure to said chemical section a chemical cutting agent is forced in said cutting section;

i) a pressure generating section within said tool body within which pressure is generated to actuate said anchoring means and to displace said cutting agent into said cutting section;

j) a plurality of cutting ports in said cutting section for the discharge of chemical cutting agent therefrom extending transversely of the major axis of said elongated tool body, said cutting ports being arranged in at least first and second groups;

k) said first group of cutting ports being arranged in a configuration conforming to the desired shape of a cut to be made in the conduit and defining a first planar pattern; and l) said second group of said cutting ports defining a second planar pattern generally conforming to said first pattern and being in a canted relationship with said first pattern.

16. The combination of claim 15, wherein said first and second groups of cutting ports are arranged circumferentially of said elongated tool body whereby said first and planar patterns are generally normal to the major axis of said tool body.

17. The combination of claim 15, wherein said first and second planar patterns are in a converging relationship.

18. The combination of claim 17, wherein said first group of cutting ports defining said first planar pattern are in a downwardly converging relationship with respect to said second group of cutting ports defining said second pattern.

19. The combination of claim 18, wherein said first and second patterns intersect at a location with the wall of tubular conduit.

20. The combination of claim 19, wherein at least some of the cutting ports in said first group are in a staggered relationship longitudinally along said tool body relative to at least some of the cutting ports in said second group.

21. The combination of claim 20, further comprising a third group of cutting ports defining a third planar pattern generally conforming to said first and second planar patterns and being located below said second pattern.

22. The combination of claim 21, wherein said third planar pattern is in a converging relationship with said first and second planar patterns.

23. In a method of cutting tubular well goods at a downhole location within a well extending into the earth from a well head, the steps comprising:

a) inserting into said well a chemical cutting tool having a chemical section containing a chemical cutting agent adapted to interact with a tubular member in said well to form a cut in said tubular member and further having a cutting section adapted to receive said cutting agent from said chemical section;

b) lowering said chemical cutting tool through said well to a desired location within said tubular member at which said cut is to be made;

c) discharging said cutting agent from said chemical section into contact with an ignitor material to effect an exothermic pre-reaction of said chemical cutting agent, said ignitor material being formed in a permeable accumulation of a first metallic component formed of a first metal which is reactive with said cutting agent in an exothermic reaction at a first temperature and a second metallic component formed of a second metal interposed within said first component and which is reactive with said cutting agent in an exothermic reaction at a second temperature higher than first temperature;

d) dispensing said pre-ignited chemical cutting agent from said cutting tool in a plurality of jet streams emanating from a plurality of cutting ports in the cutting section of said tool and into the contact with the inner surface of said tubular member to effect a cut in said tubular member.

24. The method of claim 23, wherein said cutting agent is dispensed through a first group of cutting ports arranged in a configuration conforming to the desired shape of the cut made in said tubing member and defining a first planar pattern, and through a second group of cutting ports defining a second planar pattern generally conforming to said first pattern and being in a canted relationship with said first pattern.

25. The method of claim 24, wherein said first and second groups of cutting ports are arranged circumferentially of said cutting tool whereby said first and planar patterns are generally normal to the axis of said tubular member to form a circumferential cut within said tubular member.

26. The method of claim 25, wherein said first and second planar patterns are in a converging relationship.

27. The method of claim 26, wherein said first and second patterns intersect at a location within the wall of said tubular member.

28. The method of claim 27, further comprising a third group of cutting ports defining a third planar pattern generally conforming to said first and second planar patterns and being located below said second pattern.

29. The method of claim 28, wherein said third planar pattern is in a converging relationship with said first and second planar patterns.

30. In a downhole chemical cutting tool having an elongated tool body adapted to be inserted into a conduit and positioned at a downhole location thereof for effecting a cutting action in said conduit, the combination comprising:

a) a chemical section in said elongated tool body adapted to contain a chemical cutting agent;

b) a cutting section in said elongated tool body adapted to receive a chemical cutting agent from said chemical section;

c) a plurality of cutting ports in said cutting section for the discharge of chemical cutting agent therefrom extending transversely of the major axis of said elongated tool body, said cutting ports being arranged circumferentially of said elongated tool body in at least first and second groups;

d) said first group of cutting ports being arranged in a generally planar pattern which is generally normal to the major axis of said tool body; and e) said second group of said cutting ports being arranged in a second generally planar patterns which is generally normal to the major axis of said tool body and which is in a converging relationship with said first pattern and intersects said first pattern at an exterior location which is spaced from the exterior surface of said cutting section.

31. The combination of claim 30, wherein the said location is spaced from the exterior of said cutting section by at least 0.2 inch.

* * * * *